US005095875A

United States Patent [19]

Morris et al.

[11] Patent Number: 5,095,875

[45] Date of Patent: Mar. 17, 1992

[54] KNIFE FOR PRODUCING WAFFLE AND LATTICE CUTS

[76] Inventors: Carl Morris, P.O. Box 121, Blaine, Me. 04734; Stephen Dowbiggin, Riverview Drive, Florenceville, New Brunswick, Canada, E0J 1K0

[21] Appl. No.: 369,141

[22] Filed: Jun. 21, 1989

[51] Int. Cl.[5] ..... B26D 3/28

[52] U.S. Cl. ..... 83/856; 83/403; 83/404.3

[58] Field of Search ..... 83/403, 404.3, 651, 83/856-858

[56] References Cited

U.S. PATENT DOCUMENTS

| | | | |
|---|---|---|---|
| 2,832,387 | 4/1958 | Woodward, Jr. | 83/403 |
| 2,961,024 | 11/1960 | Urschel et al. | 83/403 |
| 3,139,127 | 6/1964 | Urschel et al. | 83/403 X |
| 3,139,130 | 6/1964 | Urschel et al. | 83/417 X |
| 4,523,503 | 6/1985 | Julian et al. | 83/403 |
| 4,590,835 | 5/1986 | Matsuo | 83/403 X |

*Primary Examiner*—Hien H. Phan
*Assistant Examiner*—Eugenia A. Jones

[57] ABSTRACT

A integrally-formed knife for producing thick waffle-cut and lattice-cut potato slices has a blade and a shank extending rearwardly from the blade. The blade has opposing inclined surfaces which meet at a forward blade portion to define a thin corrugated cutting edge. Each blade surface has undulations defining a set of alternating grooves and ridges each extending rearwardly from the cutting edge and terminating at the shank. The relative inclination of the blade surfaces results in progressively greater blade thickness at a rear blade portion such that the blade is relatively rigid and self-supporting. This eliminates use of clamps on the opposing blade faces and consequent interference by clamps with slicing. The sets of grooves diverge relative to one another adjacent the rear blade portion where their bottoms are spaced in a direction transverse to the blade surfaces. The shank is unobtrusively connected to the relatively wide rear blade portion between the bottoms of rearward ends of the grooves. The shank has apertured mounting tabs extending laterally beyond either side of the blade to permit mounting in a conventional rotary-type potato slicer.

9 Claims, 3 Drawing Sheets

KNIFE FOR PRODUCING WAFFLE AND LATTICE CUTS

FIELD OF THE INVENTION

The invention relates to knives for cutting foodstuffs such as potatoes into waffle-cut or lattice-cut slices.

BACKGROUND OF THE INVENTION

It is known to use a rotary-type slicing machine to produce both waffle-cut and lattice-cut potato slices for preparation of french-fried potatoes or potato chips. Waffle-cut potato slices generally have alternating ridges and grooves on opposing faces, the grooves being relatively shallow compared to the thickness of the slices. Lattice-cut potato slices are similar, but the grooves on one face are transverse to those on an opposing face and are cut sufficiently deep as to intersect and produce a lattice-like appearance.

Rotary-type potato slicing machines for such purposes are described in U.S. Pat. Nos. 3,139,127 and 3,139,130 to Urschel et al. Such slicing machines comprise a central rotating carriage and a plurality of radial guides fixed to the carriage. Potatoes received by the central carriage are urged by centrifugal forces outwardly through the radial guides against stationary knife assemblies. These knife assemblies are typically mounted on a housing sidewall having a part-spherical shape and extend at preselected angles from the sidewall into the path of the orbiting potatoes. Thin slices are produced as each potato successively engages the various knife assemblies, each slice escaping tangentially through an opening in the housing sidewall located outwardly of an particular cutting blade.

The knife assemblies of the Urschel machine use thin corrugated blades to produce waffle and lattice cuts. In order to produce transverse networks of grooves on opposing faces of a potato slice, the radial guides and the potatoes contained therein are rotated synchronously with rotation of the carriage. The cut surface of each potato is essentially rotated through 90 degrees between successive engagements with a knife assembly. If the amplitude of the blade corrugations is sufficiently great relative to the thickness of the slices being cut then the resulting potato slices have a lattice-shape.

The original Urschel slicer is limited to producing lattice-cut slices having a thickness of no more than about ⅛ inch. Similar limitations arise in the depth of waffle-cuts which can be produced. This problem arises largely because of the construction and support of the blade. Each blade is essentially a thin sheet of metal appropriately bent to form longitudinal corrugations. Since the blade is relatively flexible, it is commonly supported by clamping its opposing faces rearwardly of its leading cutting edge. If the amplitude of the corrugations is sufficiently great to produce relatively thick lattice-cut slices, there is a tendency for an inner clamping member to shear ridges freshly-cut on a potato and for an outer clamping member to shear ridges freshly-cut on an escaping potato slice.

This shortcoming in the Urschel cutter is addressed in prior U.S. Pat. No. 4,523,503 to Julian et al. The Julian patent suggests that clamping members be formed with tapered fingers which extend forwardly into the grooves of an associated blade. As a potato and slice are advanced along the thin corrugated blade, they encounter the fingers and are raised clear of the clamping members. One significant shortcoming associated with such devices is that considerable debris tends to lodge between the blade, fingers and clamping member, which complicates cleaning of the rotary cutter. Similar blade clamp features are taught in prior U.S. Pat. No. 4,120,089 to Börner.

The present invention addresses the same problem, but seeks to modify the construction of the blade itself in a such a manner that the clamping members which might otherwise interfere with proper cutting of a potato slice are entirely eliminated.

BRIEF SUMMARY OF THE INVENTION

In one aspect, the invention provides a knife for use in producing waffle-cut or lattice-cut slices of potatoes or other foodstuffs, comprising a rigid blade having opposing blade surfaces which meet at a forward blade portion to define a thin corrugated cutting edge. Each blade surface has undulations defining a multiplicity of alternating grooves and ridges each commencing at the cutting edge and extending rearwardly from the cutting edge to a rear blade portion spaced from the forward blade portion. The grooves and ridges are "elongate", that is, the length of each groove and ridge in a front-to-rear direction exceeds the lateral spacing between adjacent groove bottoms or adjacent ridge tops of the blade surface at the corrugated cutting edge. The opposing blade surfaces are generally inclined relative to one another such that the thickness of the blade increases continuously from the forward blade portion to the rear blade portion.

The knife preferably includes a shank integrally formed with the blade and attached to the rear blade portion between the opposing blade surfaces. The shank may be appropriately adapted to permit installation into a slicing machine. Outer surfaces of the blade and shank may be generally convex in side-to-side cross-section and the inner surfaces may be generally concave to conform more closely to part-spherical housings commonly provided in rotary-type slicers.

The construction and advantages of a knife embodying the invention are best understood by considering a prior art corrugated blade. Such a prior blade is formed of thin sheet metal with substantially parallel opposing surfaces. The blade is consequently very flexible and requires clamping of its opposing faces to properly support the blade during cutting operations. In the present invention, the two undulated surfaces of such a prior blade are effectively rotated outwardly about the cutting edge to arrive at a generally wedge-like blade. The blade is consequently more rigid than prior sheet metal blades thereby eliminating the need for surface clamping members which might otherwise interfere with production of deep waffle- and lattice-cuts. The rigidity can be increased markedly for any given material and overall blade size by simply increasing the general inclination of the blade surfaces. The freedom to select the thickness of the rear blade portion also allows convenient mounting in a rotary slicing machine, as with a shank extending rearwardly in an unobtrusive manner from the rear blade portion or with mounting tabs extending laterally from the rear blade portion itself. Since surface clamps are not required, there is no need for clamp fingers or other structures which collect debris during slicing operations and are potentially subject to breakage and additional maintenance requirements.

Other aspects of the present invention will be apparent from a description of a preferred embodiment below and will be defined in greater detail in the appended claims.

DESCRIPTION OF THE DRAWINGS

The invention will be better understood with reference to drawings in which.

DESCRIPTION OF PREFERRED EMBODIMENT

Figure 1:
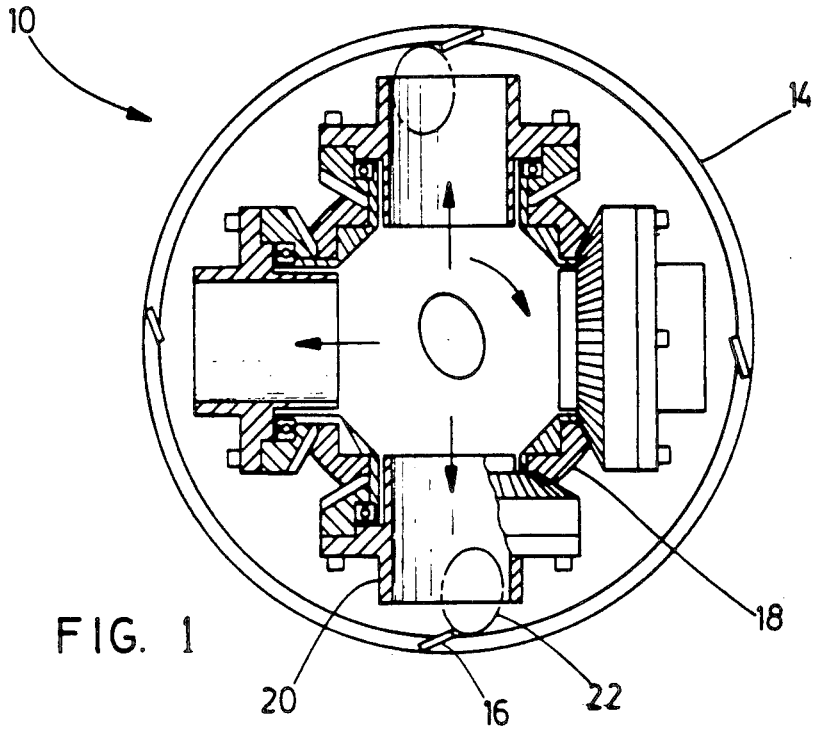
FIG. 1 is a diagrammatic plan view of an Urschel-type slicer incorporating slicing knives embodying the invention.

Reference is made to FIG. 1 which illustrates an Urschel-type potato slicing machine 10. It comprises a stationary housing 12 with a generally annular (part-spherical) sidewall 14. A plurality of identical knives are equally-spaced circumferentially along the sidewall 14, such as the knife 16. A rotary carriage 18 is mounted centrally within the sidewall 14 and comprises a plurality of radial guides, such as the guide 20. Potatoes received by the carriage 18 are directed radially by centrifugal forces through the guides until they engage the housing sidewall 14. With rotation of the carriage 18, the knives remove successive slices from the potatoes. Exemplary is the potato 22 shown engaging the knife 16.

Figure 3:
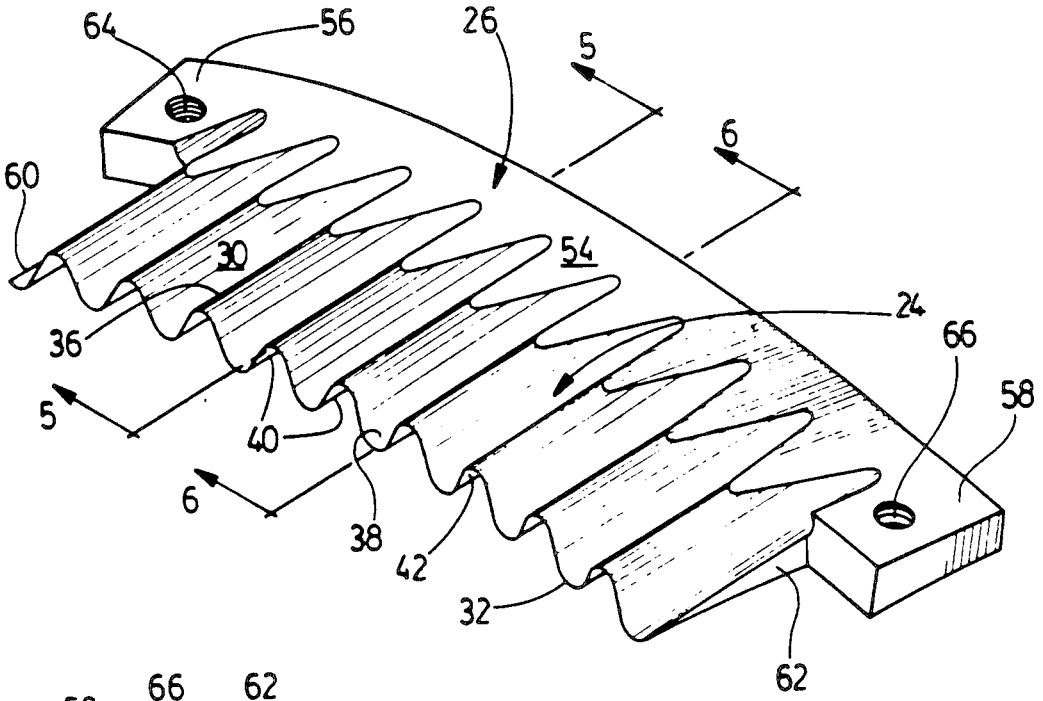
FIG. 3 is a perspective view of an outer surface of a knife constructed according to the invention.
Figure 4:
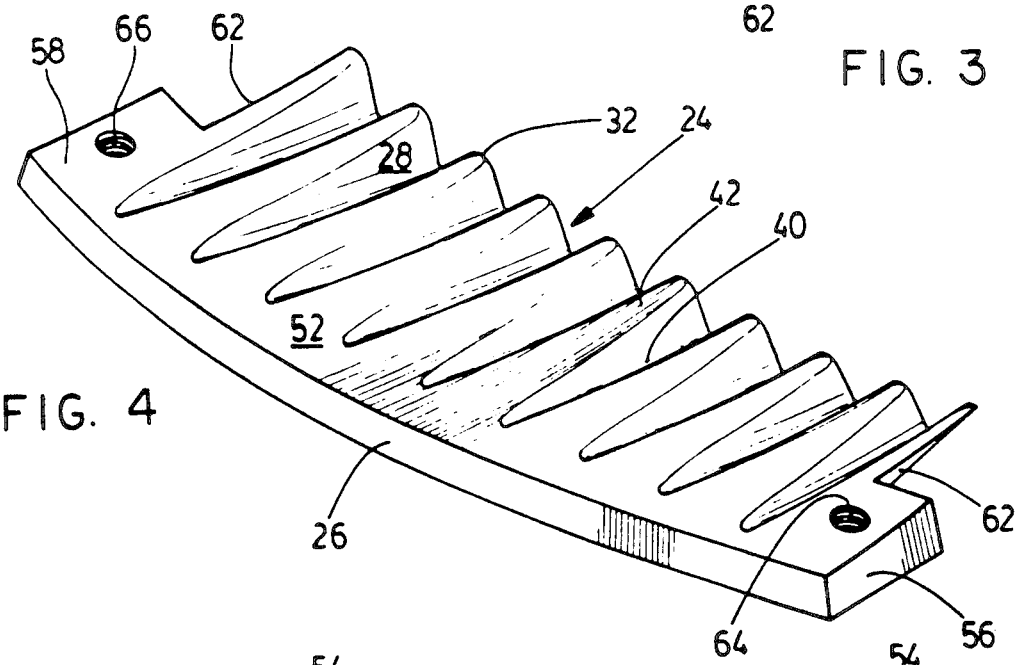
FIG. 4 is a perspective view of the opposing inner surface of the knife.

The knife 16 which is typical comprises a blade 24 and a shank 26 integrally formed of steel as apparent, for example, in FIGS. 3 and 4. These are made by casting the metal in the required configuration and then machining the surfaces of the casting. The blade 24 may be seen to comprise opposing inner and outer blade surfaces 28, 30 which meet in angled relationship (forming an angle of between about 8 and 15 degrees) at a forward blade portion to define a thin corrugated cutting edge 32. The peak-to-peak amplitude of the corrugations of the cutting edge 32 might typically be in excess of about one-eighth of an inch (actually about one-quarter inch in the blade 24), making the blade 24 appropriate for production of relatively thick lattice-cut potato slices.

Figure 5:
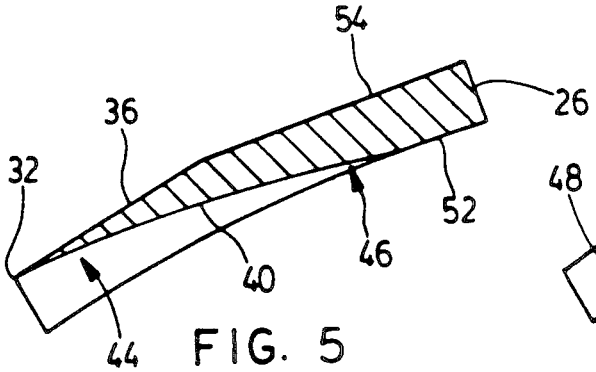
FIG. 5 is a cross-sectional view along the lines 5—5 of FIG. 3.
Figure 6:
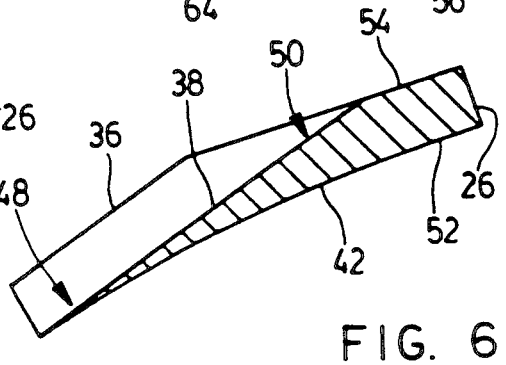
FIG. 6 is a cross-sectional view along the lines 6—6 of FIG. 3.

Each of the opposing blade surfaces 28, 30 has undulations defining a set of elongate alternating grooves and ridges each commencing at the cutting edge 32 and extending rearwardly from the cutting edge 32 to a rear blade portion and ultimately terminating at the shank 26. The length of the grooves might typically be between 1 and 2 inches while the lateral spacing between adjacent groove bottoms or ridge tops at the corrugated cutting edge 32 might typically be in the order of about one-half inch. A ridge 36 and adjacent groove 38 of the outer blade surface 30 are typical of the outer set and are shown in cross-section in the views of FIGS. 5 and 6. The general profiles of a typical groove 40 and adjacent ridge 42 associated with the inner blade surface 28 are also apparent respectively in FIGS. 5 and 6.

The opposing inner and outer blade surfaces 28, 30 are generally inclined relative to one another. The blade 24 consequently becomes generally thicker in cross-section from the forward blade portion to a rear blade portion spaced from the forward blade portion. The difference in thickness between forward and rear blade portions will be apparent in the cross-sectional view of FIG. 5 where points 44 and 46 associated respectively with the forward and rear blade portions are indicated, and also in FIG. 6 at points 48 and 50 associated respectively with the forward and rear blade portions. The blade 24 is accordingly quite rigid and sufficiently self-supporting that it does not require clamping members on opposing faces to ensure that the blade 24 retains a required configuration during slicing.

Figure 10:
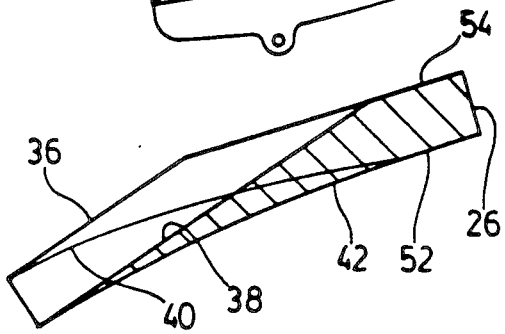
FIG. 10 is a superposition onto FIG. 6 of the cross-sectional representation in FIG. 5 of the bottom of a groove of the inner blade surface, indicating the relative inclination and spacing of adjacent grooves on opposing blade surfaces.

The relationship between bottoms of adjacent grooves on opposing blade surfaces in this embodiment of the invention is apparent from in FIG. 10. The relationship between bottoms of the adjacent grooves 38, 40 of the opposing blade surfaces is typical. The two grooves 38, 40 initially converge at the forward blade portion but diverge at the rear blade portion and are spaced at the rear blade portion, in a direction transverse to the blade surfaces 28, 30, by a distance corresponding to about the peak-to-peak amplitude of the corrugations of the cutting edge 32. The thickness of the blade 24 in this region will tend to be in excess of the peak-to-peak amplitude.

The divergence of the adjacent groove bottoms on the opposing blade surfaces 28, 30 and their spacing in this region permits the shank 26 to be unobtrusively attached to the rear portion of the blade 24. It will be apparent from FIGS. 3–6 that the shank 26 lies between the opposing blade surfaces 28, 30, at the rear blade portion where these surfaces and their grooves are significantly spaced-apart. The shank 26 has opposing inner and outer shank surfaces 52, 54 each meeting one of the opposing blade surfaces 28, 30 and the grooves formed in the blade surfaces. Each of the shank surfaces 52, 54 is so inclined relative to the blade surfaces 28, 30, respectively, that rearward ends of the blade grooves are directed outwardly of the shank 26, ensuring that the shank 26 does not obstruct the grooves and consequently the movement of either a potato being cut by the blade 24 or of a slice being freshly cut from the potato (as apparent from FIGS. 8 and 9). Basically, the divergence and separation of the opposing sets of grooves provides a blade region where the shank 26 can be connected without intruding into the grooves bottoms. In contradistinction, a shank of any practical thickness cannot be connected to the rear of a conventional sheet-like corrugated blade without intruding into the rearward ends of the opposing sets of grooves.

Figure 2:
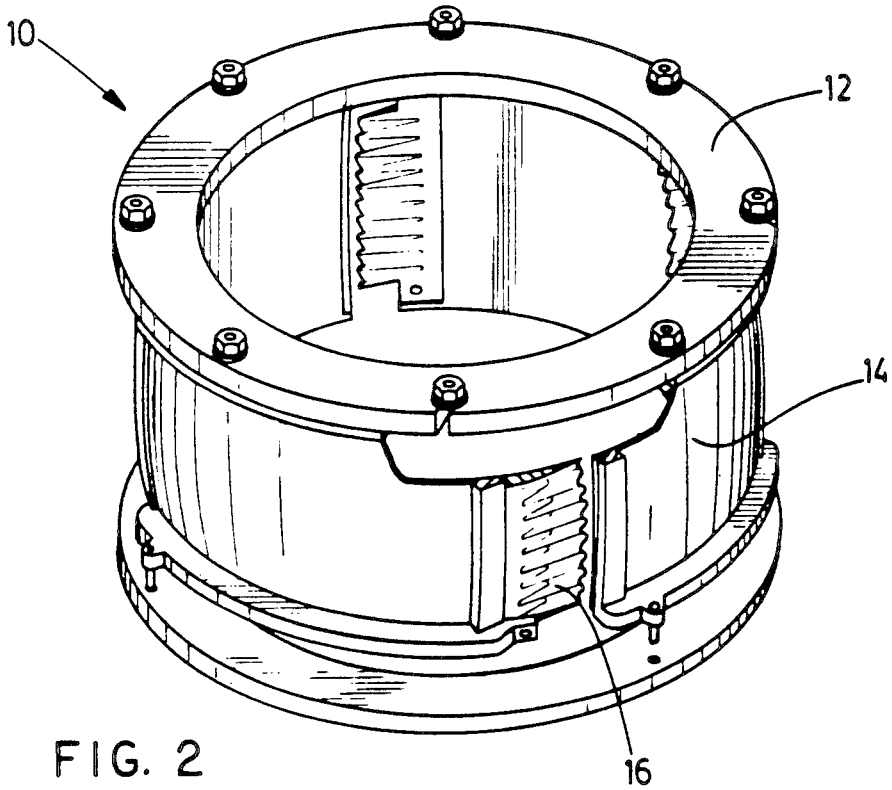
FIG. 2 is a fragmented perspective view detailing the construction of stationary slicer housing and the mounting of the knives.
Figure 7:
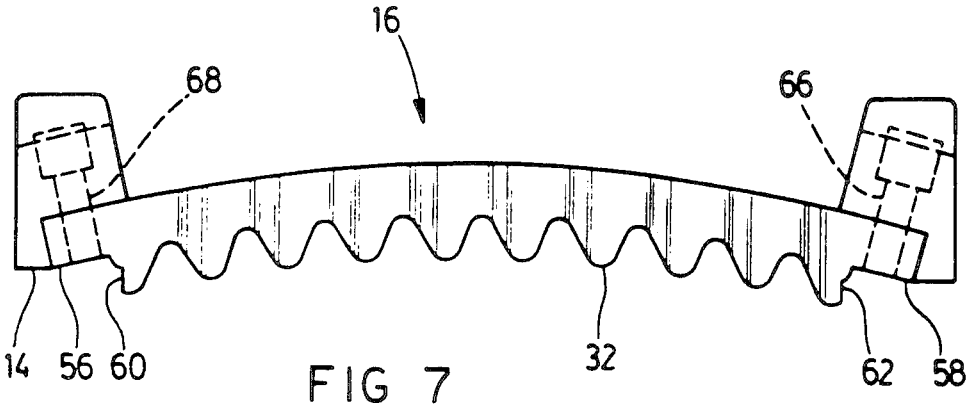
FIG. 7 is a front view of the knife illustrating its mounting in Urschel-type cutter.

The shank 26 has opposing tabs 56, 58, one tab extending laterally beyond each of the opposing sides 60, 62 of the blade 24. These tabs 56, 58 are formed with threaded apertures 64, 66 that permit the knife to be mounted to the Urschel-type potato slicing machine 10, as with the Allen screws 68, 70 apparent in FIGS. 2 and 7. Although the separation and divergence of the opposing groove bottoms at the rear blade portion permits unobtrusive attachment of the shank 26 to the rear blade portion, the same general configuration also provides a sufficiently thick and robust blade that the shank might be eliminated in favor of laterally-extending mounting tabs formed with or secured directly to the rear blade portion itself.

Figure 8:
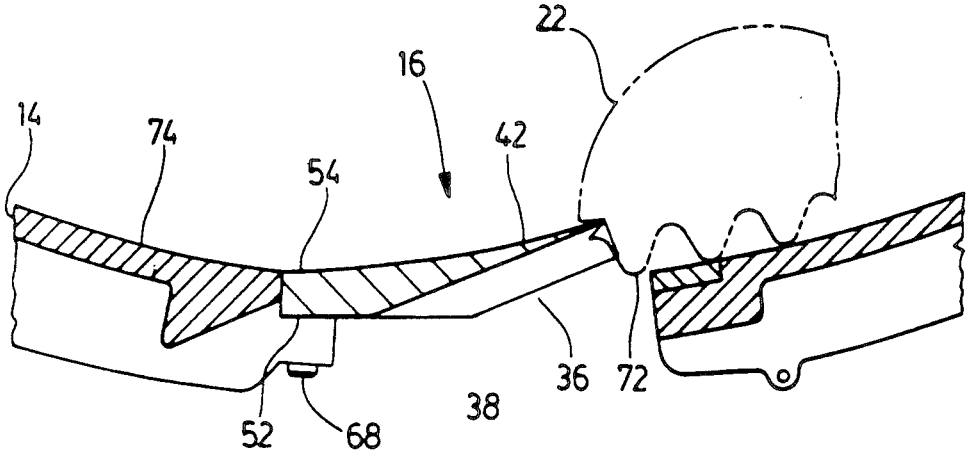
FIGS. 8 and 9 are fragmented cross-sectional view similar to the views of FIGS. 5 and 6 but showing the knife mounted on the cutter.
Figure 9:
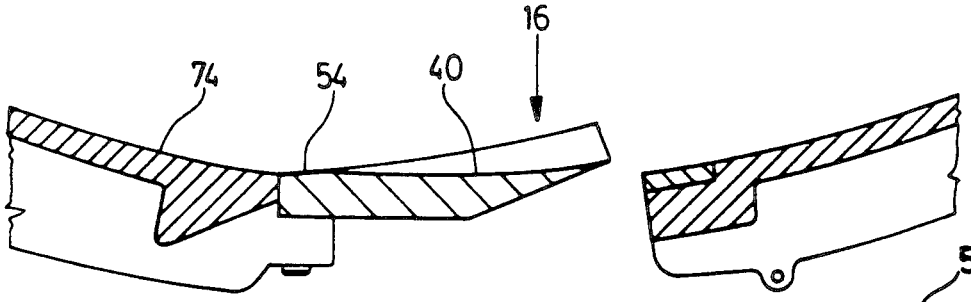

The manner in which a potato can be cut to produce a lattice-cut potato slice will be apparent from the cross-sectional view of FIG. 8 where the potato 22 is shown engaging the blade 24 of the knife 16. The exposed surface 72 of the potato 22 is assumed previously to have been formed with a first waffle-cut defining the grooves and ridges shown extending transversely to the plane of the drawing page and to have been rotated through 90 degrees to reach the orientation illustrated. As apparent in FIG. 8, the amplitude of the corrugations is sufficient to form deep grooves in the potato slice and to define a lattice-shape. Details respecting angling of the blade 24, selection of opening size and the like will be apparent from the teachings of the prior Urschel patents which are incorporated herein by reference.

A number of matters regarding the specific shape of the blade 24 and shank 26 should be noted. First, the outer blade surface 30 is generally convex (essentially part-spherical) in side-to-side cross-section while the inner blade surface 28 is generally concave (also essentially part-spherical) in side-to-side cross-section. This is largely to allow the blade 24 to conform generally to the part-spherical shape of the housing sidewall 14 of the associated Urschel-type slicing machine 10. The shank surfaces 52, 54 are similarly configured for similar reasons.

With respect to the outer blade surface 30, it will be noted that the tops of the ridges and the bottoms of the grooves are parallel and straight (as apparent in FIGS. 5 and 8), as on the outer surface of a more conventional sheet-like corrugated blade. The grooves and ridges of the inner blade surface 28 might be similarly configured, with the bottoms of the grooves positioned flush with the inner surface 74 of the slicer sidewall 14. However, as apparent in FIG. 9 where the typical inner groove 40 and ridge 42 are illustrated in cross-section, the ridges and grooves of the inner blade surface 28 may be appropriately machined so that a potato being processed sees a smoother transition between the inner blade surface 28 and the inner surface 74 of the cutter sidewall 14. In particular, the inner grooves curve radially inwardly from the forward blade portion to the rear blade portion. The ridges of the inner blade surface 28 are continuously reduced (by appropriate machining) from the forward blade portion to the rear blade portion. The curvature of the inner grooves and ridges and also that of the inner shank surface 52 is such that the inner surfaces presented by the knife to a potato flows more smoothly into the inner housing surface 74, as apparent in FIG. 9.

It will be appreciated that a particular embodiment of the invention has been described and that modifications may be made therein without necessarily departing from the spirit of the invention or the scope of the appended claims.

The embodiments of an invention in which an exclusive property or privilege is claimed are defined as follows:

1. A knife for use in producing waffle-cut or lattice-cut slices of potatoes or other foodstuffs, comprising a rigid blade having opposing blade surfaces meeting at a forward blade portion to define a thin corrugated cutting edge, each of the opposing blade surfaces having undulations defining a multiplicity of alternating elongate grooves and ridges each commencing at the cutting edge and extending rearwardly from the cutting edge to a rear blade portion spaced from the forward blade portion, the opposing blade surfaces being generally inclined relative to one another such that the thickness of the blade increases continuously from the forward blade portion to the rear blade portion;

said opposing surfaces as measured in longitudinal planes containing said ridges associated with one said surface converging on approach to said cutting edge at a different rate to said opposing surfaces as measured in longitudinal planes containing said ridges associated with the other said surface.

2. A knife as claimed in claim 1 comprising a shank extending rearwardly from the rear blade portion and attached to the rear blade portion between the opposing blade surfaces, the shank having opposing shank surfaces each meeting a different one of the opposing blade surfaces, each shank surface being so inclined relative to the blade surface met by the shank surface that rearward ends of the grooves of each blade surface are directed outwardly of the shank.

3. A knife as claimed in claim 2 in which the blade is integrally formed with the shank.

4. A knife as claimed in claim 3 in which one of the opposing blade surfaces and the shank surface met by the one of the opposing blade surfaces are generally convex in side-to-side cross-section and the other of the opposing blade surfaces and the shank surface met by the other of the opposing blade surfaces are generally concave in side-to-side cross-section.

5. A cutting knife as claimed in claim 4, wherein said opposing surfaces measured in longitudinal planes containing said ridges associated with said convex surface converge at a greater rate than said opposing surfaces as measured in longitudinal planes containing said ridges associated with said concave surface.

6. A knife as claimed in claim 1 in which the corrugations of the cutting edge have a peak-to-peak amplitude of at least about one-eighth of an inch.

7. A knife for use in producing waffle-cut or lattice-cut slices of potatoes or other foodstuffs, comprising a rigid blade having opposing blade surfaces inclined relative to one another and meeting at a forward blade portion to define a thin corrugated cutting edge having corrugations of a predetermined peak-to-peak amplitude, each of the opposing blade surfaces having undulations defining a multiplicity of alternating grooves and ridges commencing at the cutting edge and extending rearwardly from the cutting edge to a rear blade portion, the opposing blade surfaces diverging generally and continuously relative to one another from the forward blade portion to the rear blade portion such that the rear blade portion has a cross-sectional thickness between the opposing blade surfaces of at least about the peak-to-peak amplitude of the corrugations each opposing blade surface having an angle of divergence which is measured along the ridges associated with each said surface, the angles of divergence differing from each other.

8. A knife for use in producing waffle-cut or lattice-cut slices of potatoes or other foodstuffs, comprising:

a blade having forward and rear blade portions;

a shank extending rearwardly from the rear blade portion;

the blade having opposing blade surfaces meeting in angled relationship at the forward blade portion to define a thin corrugated cutting edge, each of the opposing blade surfaces having undulations defining a multiplicity of alternating grooves and ridges commencing at and extending rearwardly from the cutting edge and terminating at the shank, bottoms of the grooves of one of the opposing blade surfaces diverging relative to and being spaced in a direction perpendicular to the blade surfaces from bottoms of adjacent grooves of the other of the opposing blade surfaces adjacent to the shank;

said surfaces as measured in longitudinal planes containing the ridges and grooves associated with one said surface converging on approach to said cutting edge at a greater angle than said surfaces as measured in longitudinal planes containing the ridges and grooves associated with the other said surface.

9. A knife for use in producing waffle-cut or lattice-cut slices of potatoes or other foodstuffs, comprising a rigid blade having opposing blade surfaces inclined relative to one another such that the blade is generally thicker in cross-section at a rear blade portion than at a forward blade portion, the opposing blade surfaces meeting in angled relationship at the forward blade portion to define a thin corrugated cutting edge, each of the opposing blade surfaces having undulations defining a multiplicity of alternating grooves and ridges commencing at the cutting edge and extending rearwardly from the cutting edge to the rear blade portion, each of the grooves of each of the opposing blade surfaces having a bottom, the bottom of each groove of one of the opposing blade surfaces subtending an angle of convergence towards the bottoms of adjacent grooves of the other of the opposing blade surfaces at the forward blade portion and subtending an angle of divergence relative to the adjacent grooves at the rear blade portion said angle of convergence adjacent the cutting edge of said knife as measured in planes bisecting said grooves being greater for grooves associated with one said surface than for grooves associated with the other said surface.

* * * * *

UNITED STATES PATENT AND TRADEMARK OFFICE

CERTIFICATE OF CORRECTION

PATENT NO. : 5,095,875

DATED : March 17, 1992

INVENTOR(S) : Carl Morris and Stephen Dowbiggin

It is certified that error appears in the above-identified patent and that said Letters Patent is hereby corrected as shown below:

Title page, assignee should read

-- [73] Assignee: McCain Foods Limited, Florenceville, New Brunswick, Canada--.

Signed and Sealed this

Fourteenth Day of September, 1993

Bruce Lehman

*Attest:*

BRUCE LEHMAN

*Attesting Officer*

*Commissioner of Patents and Trademarks*